US005772407A

United States Patent [19]

Kato et al.

[11] Patent Number: 5,772,407

[45] Date of Patent: Jun. 30, 1998

[54] RECIPROCATING PISTON TYPE COMPRESSOR IMPROVED TO DISTRIBUTE LUBRICATING OIL SUFFICIENTLY DURING THE STARTING PHASE OF ITS OPERATION

[75] Inventors: Ryo Kato; Atsushi Fukaya; Naoya Yokomachi; Masanori Iwadou, all of Kariya, Japan

[73] Assignee: Kabushiki Kaisha Toyoda Jidoshokki Seisakusho, Kariya, Japan

[21] Appl. No.: 638,995

[22] Filed: Apr. 23, 1996

[30] Foreign Application Priority Data

Apr. 28, 1995 [JP] Japan ..... 7-106569

[51] Int. Cl.[6] ..... F04B 1/16

[52] U.S. Cl. ..... 417/269; 184/6.16

[58] Field of Search ..... 417/269; 91/499, 91/504, 505; 184/6.16

[56] References Cited

U.S. PATENT DOCUMENTS

| | | | |
|---|---|---|---|
| 3,057,545 | 10/1962 | Ransom et al. | 417/269 |
| 3,749,523 | 7/1973 | Wahl, Jr. | 417/269 |
| 3,833,318 | 9/1974 | Nakayama et al. | 417/269 |
| 3,888,604 | 6/1975 | Oshima et al. | 417/269 |
| 4,061,443 | 12/1977 | Black et al. | 417/269 |
| 4,974,702 | 12/1990 | Yokomachi et al. | 417/269 |
| 5,009,286 | 4/1991 | Ikeda et al. | 417/269 |
| 5,009,574 | 4/1991 | Ikeda et al. | 417/269 |
| 5,088,897 | 2/1992 | Kawai et al. | 417/269 |

FOREIGN PATENT DOCUMENTS

| | | | |
|---|---|---|---|
| 0194092 | 11/1984 | Japan | 417/269 |

*Primary Examiner*—Timothy Thorpe
*Assistant Examiner*—Peter G. Korytnyk
*Attorney, Agent, or Firm*—Burgess, Ryan & Wayne

[57] ABSTRACT

A reciprocating piston type compressor for compressing refrigerant gas includes a plurality of pistons slidably provided within cylinder bores for reciprocation. A pair of housings are mounted to the either ends of the cylinder block with valve plates therebetween. The housings include at least a refrigerant gas suction chamber which is fluidly connected to the cylinder bores. An oil sump is provided for containing lubricating oil. An oil pump is provided for distributing the lubricating oil to the compressor elements. The oil pump includes oil suction which is fluidly connected to the oil sump through a oil suction passage. The pressure in the refrigerant gas suction chamber is introduced into the oil suction chamber to direct the lubricating oil into the oil suction chamber from the oil sump during the initial stage of the starting of the compressor.

8 Claims, 6 Drawing Sheets

RECIPROCATING PISTON TYPE COMPRESSOR IMPROVED TO DISTRIBUTE LUBRICATING OIL SUFFICIENTLY DURING THE STARTING PHASE OF ITS OPERATION

BACKGROUND OF THE INVENTION

1. Field of the Invention

The present invention relates to a lubricating system in a reciprocating piston type compressor.

2. Description of the Related Art

A reciprocating type refrigerant compressor which comprises a cylinder block including a plurality of parallel cylinder bores arranged around an axial drive shaft, and double-headed pistons slidably provided within the cylinder bores for reciprocating between the top dead center and the bottom dead center. A drive mechanism is provided to reciprocate the double-headed pistons is well known. The drive mechanism comprises an axially extending drive shaft which is operatively connected to a rotational drive source, such as an automobile engine, and a swash plate which is mounted on the drive shaft. The swash plate is engaged with the double-headed pistons through shoes mounted on the respective pistons, and is supported by a pair of thrust bearings.

The compressor further comprises an oil pump, which is driven by the drive shaft, for distributing a lubricating oil to the compressor elements, for example, the thrust bearings from an oil sump, provided at the lowermost portion of the compressor, for containing the lubricating oil. In general, small clearances are provided between the moving parts in the oil pump to prevent the moving elements from contacting with each other. During the normal operation of the oil pump, the lubricating oil fills the clearances to seal them. However, when the compressor and the oil pump are stopped, lubricating oil flows out the clearances due to the gravity and returns to the oil sump, and the refrigerant gas moves into the clearances to break the seal. Thus, when the compressor and the oil pump are started again, during the initial stage of the starting, the suction efficiency of the oil pump is significantly lowered compared with that during the normal operation, namely, the pump cannot distribute the lubricating oil sufficiently which causes seizing of the moving element of the compressor.

The invention is directed to solve the prior art problem described above, and to provide a compressor with an oil pump which is improved to distribute the lubricating oil sufficiently during the initial stage of the starting of the compressor and the oil pump.

SUMMARY OF THE INVENTION

According to the invention, there is provided a reciprocating piston type compressor for compressing refrigerant gas. The compressor includes a cylinder block with a plurality of axially extending cylinder bores arranged around the longitudinal axis of the cylinder block, a plurality of pistons slidably provided within the cylinder bores for reciprocation between the top and bottom dead centers. A pair of housings are mounted to the either ends of the cylinder block with valve plates therebetween. The housings include at least a refrigerant gas suction chamber which is fluidly connected to the cylinder bores and an external refrigerating circuit to introduce the refrigerant gas from the external refrigerating circuit into the cylinder bores when the pistons move toward the bottom dead center. An axially extending drive shaft is provided for driving the reciprocating pistons. An oil sump for containing lubricating oil is provided at the lowermost portion of the compressor. An oil pump, which is driven by the drive shaft, is provided for distributing the lubricating oil to the compressor elements. The oil pump includes oil suction and discharge chambers defined by one of the housings. The oil suction chamber is fluidly connected to the oil sump through a oil suction passage. The pressure in the refrigerant gas suction chamber is introduced into the oil suction chamber to direct the lubricating oil into the oil suction chamber from the oil sump during the initial stage of the starting of the compressor.

Preferably, the housings further include a pump chamber for housing the oil pump. The oil pump may be a trochoidal pump which includes an external gear driven by the drive shaft and an internal gear meshing with the external gear. In one embodiment of the invention, the pressure in the refrigerant gas suction chamber is introduced through a passage which is provided in the wall of the pump chamber. In another embodiment of the invention, the pressure in the refrigerant gas suction chamber is introduced through a passage which is provided in the valve plate.

When the compressor is started, gas pressure in the refrigerant gas suction chamber is reduced immediately due to the reciprocation of the pistons. The reduced pressure level in the refrigerant gas suction chamber is introduced into the oil suction chamber through the passage. Thus, the lubricating oil is quickly directed into the oil suction chamber from the oil sump even if the compressor is started at a low speed. The lubricating oil reaching the oil suction chamber seals the clearances between the moving parts of the oil pump, which increases the suction efficiency of the oil pump. Therefore, the lubricating oil is distributed to the pump elements during the initial stage of the starting of the compressor, which prevents seizing of the elements.

According to another embodiment of the invention, the oil suction chamber includes first and second oil suction chambers, and the oil suction passage includes first and second oil suction passages. The first oil suction passage opens into the oil sump at a level near the bottom while the second oil suction passage opens into the oil sump at a level directly beneath the top surface of the oil contained in the oil sump when the compressor is not in operation. The pressure in the refrigerant gas suction chamber is introduced through a passage which is provided between the refrigerant gas suction chamber and the second oil suction chamber.

After the compressor is started, the level of the lubricating oil in the oil sump is lowered so that the opening of the second oil suction passage appears above the surface of the oil. Thus, when the compressor and the oil pump are in the normal operation, the oil is not directed to the second oil suction chamber through the second oil suction passage, which minimizes the oil directed to the refrigerant gas suction chamber, namely, the entainment of the oil into the refrigerant gas is reduced.

BRIEF DESCRIPTION OF THE DRAWINGS

These and other objects and advantages and further description will now be discussed in connection with the drawings in which.

DESCRIPTION OF THE PREFERRED EMBODIMENTS

Figure 1:
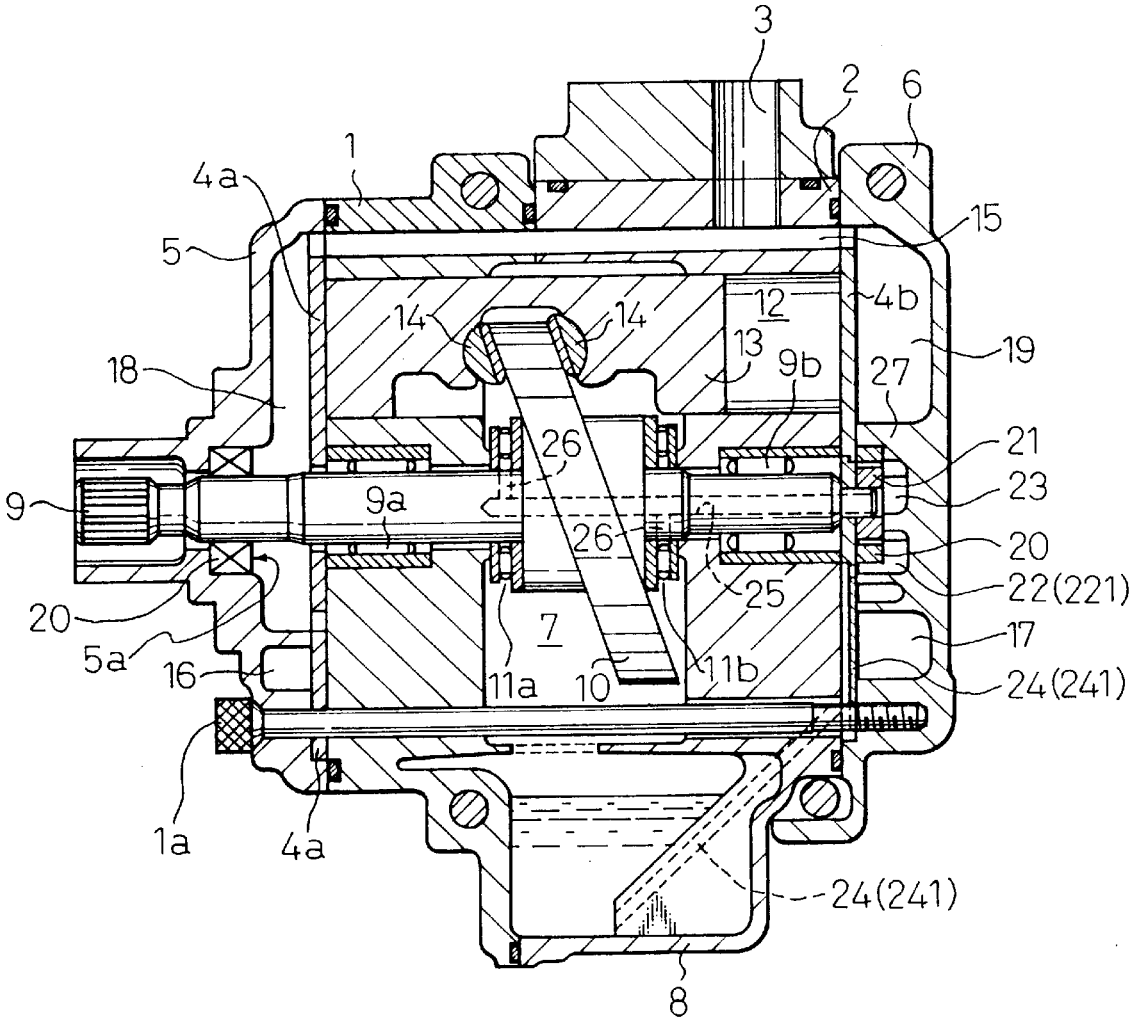
FIG. 1 is a longitudinal section of a reciprocating piston type compressor to which the invention is applied.
Figure 2:
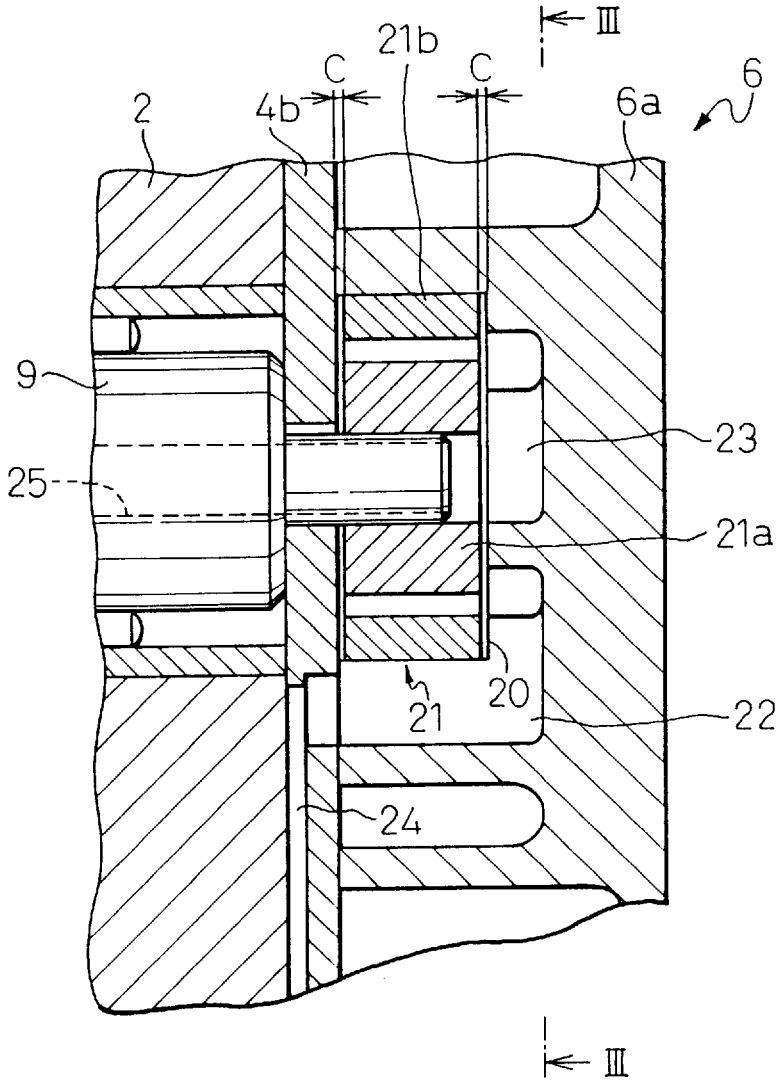
FIG. 2 is an partial enlarged illustration of the compressor of FIG. 1 around the oil pump.

With reference to FIGS. 1 and 2, a double-headed piston swash plate type refrigerant compressor is provided with front and rear cylinder blocks 1 and 2 axially connected together by means of screw bolts 1*a* to form an integral cylinder block assembly, an axially extending drive shaft 9 which is mounted to the cylinder block assembly for rotation by a pair of radial bearings 9*a* and 9*b*, and front and rear housings 5 and 6 which are sealingly mounted to the respective ends of the integral cylinder block assembly with a pair of valve plates 4*a* and 4*b* therebetween. The integral cylinder block assembly 1 and 2 further includes a central swash plate chamber 7 within which an inclined swash plate 10 is mounted on the drive shaft 9.

One end of the drive shaft 9, i.e., a front end of the drive shaft 9, outwardly extends through a housing bore 5*a* included in the front housing 5, so that the compressor can be operatively connected to a rotary drive source, such as an automobile engine (not shown) via an appropriate transmission mechanism (not shown) . A seal 20 is provided in the housing bore 5*a* to prevent the refrigerant gas from leaking between the housing bore 5*a* and the drive shaft 9. The opposite end of the drive shaft 9 extends through rear valve plate 4*b*.

The compressor further includes an oil sump 8 which is fluidly connected to the central swash chamber 7, at the lowermost portion of the compressor and a plurality of axially extending cylinder bores 12 which are arranged about the longitudinal axis of the integral cylinder block assembly. A pair of thrust bearings 11*a* and 11*b* are mounted on the drive shaft 9 between the front and rear cylinder blocks 1 and 2.

The cylinder bores 12 are equally spaced in the integral cylinder block assembly 1 and 2 about the axis of the drive shaft 9. Within the cylinder bores 12, double-headed pistons 13 are slidably provided for reciprocation between top and bottom dead centers. The inner surface of the respective cylinder bores 12 and the ends of the double-headed pistons 13 define compression chambers.

The inclined swash plate 10 engages the double-headed pistons 13 through shoes 14 which are socketed in the respective pistons 13. Thus, the rotation of the drive shaft 9 is converted into the reciprocation of the double-headed pistons 13 within the cylinder bores 12 via the swash plate 10.

The compressor further includes front and rear discharge chambers 16 and 17, and front and rear refrigerant gas suction chambers 18 and 19, which are defined, substantially in the form of rings, by the valve plates 4*a* and 4*b* and the front and rear housings 5 and 6. The front and rear discharge chambers 16 and 17 are fluidly connected to each other by a discharge passage (not shown) provided in the integral cylinder block assembly. On the other hand, the front and rear refrigerant gas suction chambers 18 and 19 are connected to each other by a suction passage 15 which also provides fluid communication between the refrigerant gas suction chambers 18 and 19 and an evaporator (not shown) arranged in an external refrigerating circuit (not shown) through a laterally extending inlet port 3 provided on the rear cylinder block.

The rear housing 6 further includes a cylindrical pump chamber 20 which is defined by an end wall 6*a* of the rear housing 6, a ring wall 27 and the valve plate 4*b*. The pump chamber 20 houses a trochoidal pump 21 which comprises external and internal gears 21*a* and 21*b* meshing with each other. The external gear 21*a* is mounted on the end of the drive shaft 9 to rotate therewith. The rotation of the external gear 21*a* rotates the internal gear 21*b* along the inner surface of the ring wall 27. The end wall 6*a* of the rear housing 6 defines oil suction and discharge chambers 22 and 23. The oil suction chamber 22 is fluidly connected to the oil sump 8 through an oil suction passage 24 provided in the rear cylinder block 2 and the valve plate 4*b*. The oil discharge chamber 23 is fluidly connected to the thrust bearings 11*a* and 11*b* through an oil supply passage 25 and an oil supply passage branches 26.

Figure 3:
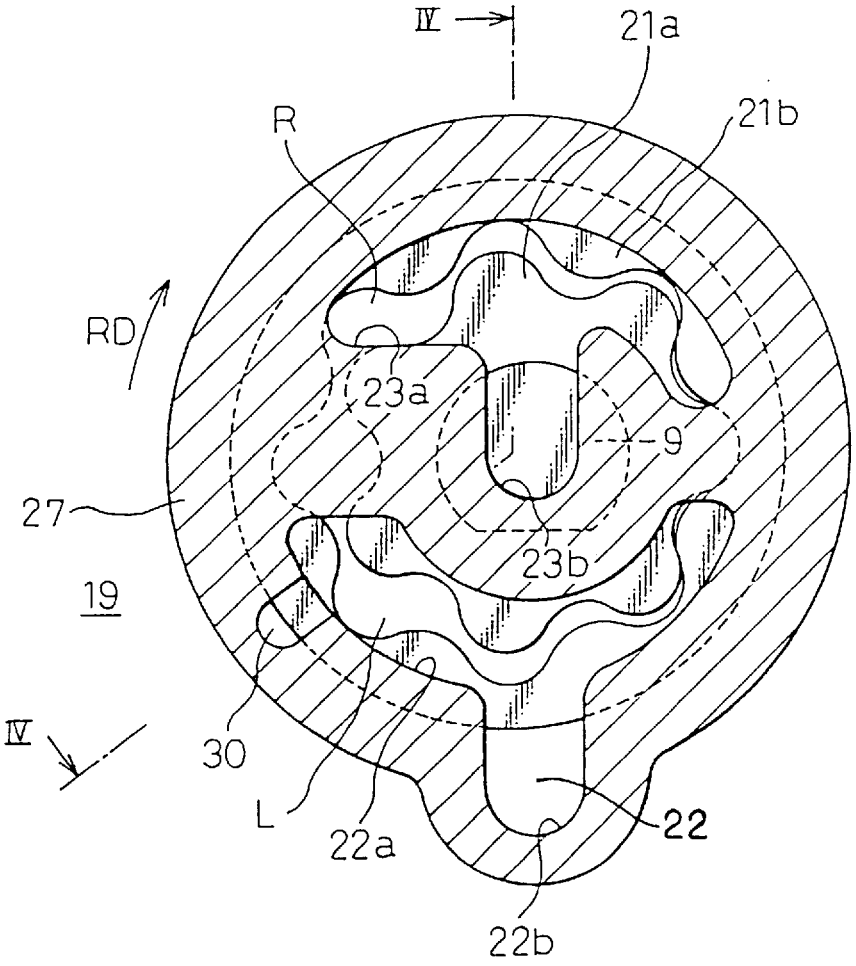
FIG. 3 is a section of the oil pump along a line III—III in FIG. 2.
Figure 4:
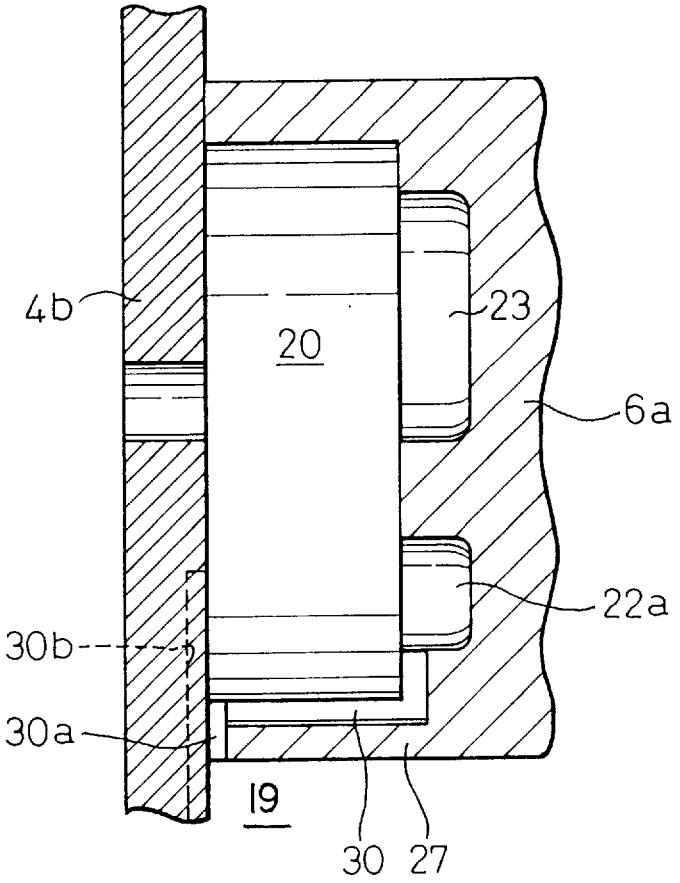
FIG. 4 is a section of the oil pump along a line IV—IV in FIG. 3.

With reference to FIGS. 3 and 4, as described above, the end wall 6*a* includes the oil suction and discharge chambers 22 and 23. The oil suction chamber 22 has an inlet opening 22*b* which is fluidly connected to the oil suction passage 24, and an outlet opening 22*a*. The outlet opening 22*a* has a substantially semicircular configuration, and opens into a suction side portion L of the pump chamber 20 where the space between the external and internal gears 21*a* and 21*b* gets larger in the rotational direction RD of the pump. The oil outlet chamber 23 has oil inlet and outlet openings 23*a* and 23*b*. The inlet opening 23*a* has a substantially semicircular configuration, and opens into a discharge side portion R of the pump chamber 20 where the space between the external and internal gears 21*a* and 21*b* gets smaller in the rotational direction RD of the pump. The outlet opening 23*b* of the oil discharge chamber 23 fluidly connected to the oil supply passage 25.

The oil suction chamber 22 and the rear refrigerant gas suction chamber 19 are fluidly connected to each other by an introducing passage provided in the ring wall 27. In this embodiment, the introducing passage includes two passages 30 and 30*a*. The passage 30 is provided in the inner surface of the pump chamber 20 to be fluidly connected to the outlet opening 22*a* of the oil suction chamber 22. The passage 30*a* is provided in the inner end of the ring wall 27 to connect the first passage 30 to the rear refrigerant gas suction chamber 19 surrounding the ring wall 27 as shown in FIG. 4. Thus, the oil suction chamber 22 and the rear refrigerant gas suction chamber 19 are fluidly connected to each other through the introducing passages 30 and 30*a* and the outlet opening 22*a* of the oil suction chamber 22. However, the introducing passage can be provided in the valve plate 4*a* instead of the two passages 30 and 30*a* as shown by a broken line 30*b* in FIG. 4.

When the pump 21 is started, as the compressor is started, gas pressure in the front and rear refrigerant gas suction chambers 18 and 19 is reduced immediately due to the reciprocation of the double-headed pistons 13. The pressure within the central swash plate chamber 7 is maintained at a pressure higher than in the refrigerant gas suction chambers 18 and 19 due to the blowby gas from the compression chambers. Thus, the pressure in the oil sump 8, which is fluidly connected to the central swash plate chamber 7, is higher than in the refrigerant gas suction chambers 18 and 19. The reduced pressure level in the rear refrigerant gas suction chamber 19 is introduced into the oil suction chamber 22 through the introducing passages 30 and 30*a*. The pressure difference between the oil sump 8 and the oil suction chamber 22 drives the lubricating oil from the oil sump 8 into the oil suction chamber 22 through the oil suction passage 24.

Therefore, the lubricating oil is quickly introduced from the oil sump 8 into the oil suction chamber 22 if the compressor is stated at a low speed. The lubricating oil reaching the oil suction chamber 22 seals the clearances between the moving parts of the oil pump, in particular, clearance C between the pump 21 and the pump chamber 20 (refer to FIG. 2), which increases the suction efficiency of the oil pump 21. Therefore, the lubricating oil is distributed to the pump elements during the initial stage of the starting of the compressor, which prevents seizing of the elements.

Figure 5:
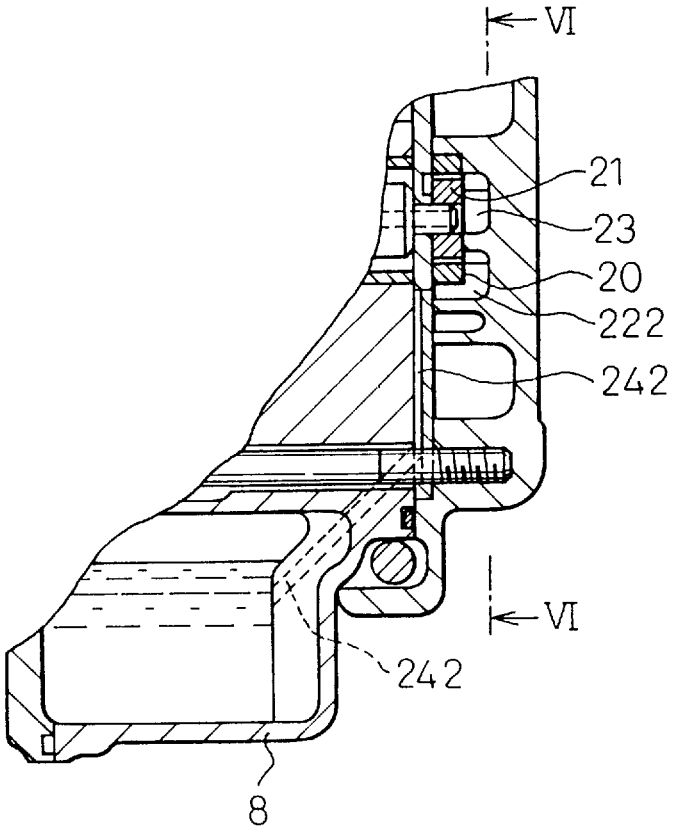
FIG. 5 is a partial sectional view of a compressor with an oil pump according to the second embodiment of the invention.
Figure 6:
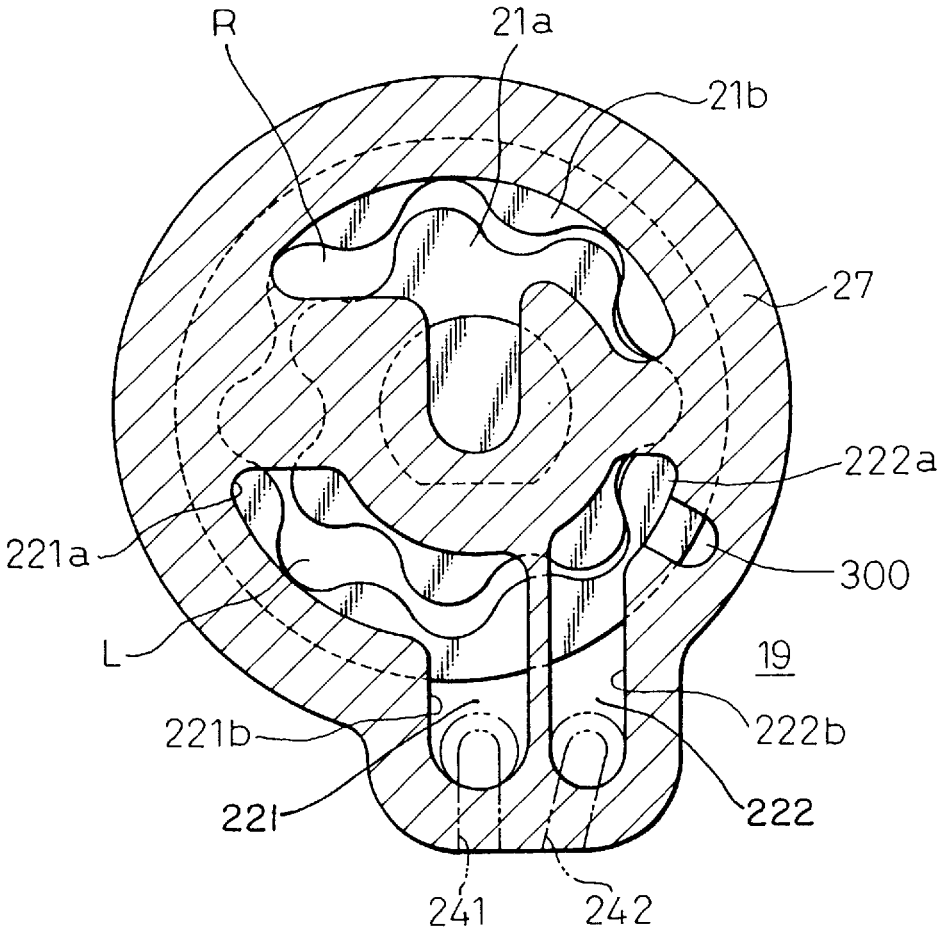
FIG. 6 is a section of the oil pump according to the second embodiment taken along a line VI—VI in FIG. 5.

With reference to FIGS. 5 and 6, the second embodiment of the invention will be described hereinafter. In the second embodiment, the oil pump is substantially the same as in the first embodiment, except that, in the second embodiment, the oil suction chamber of the oil pump includes a main oil suction chamber 221 and an additional oil suction chamber 222. In FIGS. 5 and 6, the elements similar to those in the first embodiment are indicated by the same reference numbers.

The main oil suction chamber 221 includes an inlet opening 221*b* which is fluidly connected to the oil sump 8 through a first suction passage 241 (refer to FIG. 1), and an outlet opening 221*a* which opens into the suction side portion L of the pump 21, as in the first embodiment. Likewise, the additional oil suction chamber 222 includes an inlet opening 222*b* which is fluidly connected to the oil sump 8 through a second suction passage 242 (refer to FIG. 5), and an outlet opening 222*a* which opens into the suction side portion L of the pump 21.

The first oil suction passage 241 is substantially the same as the oil suction passage 24 of the first embodiment, that is, the first oil suction passage 241 opens into the oil sump 8 at a level near the bottom as shown in fire 1. On the other hand, the second oil suction passage 242 opens into the oil sump 8 at a level, when the compressor and the oil pump are not in operation, directly beneath the top surface of the oil in the oil sump 8 as shown in FIG. 5.

The additional oil suction chamber 222 is fluidly connected to the rear refrigerant gas suction chamber 19 through an introducing passage 300, which has a function similar to that of the introducing passage 30 of the first embodiment. On the other hand, the main oil suction chamber 221 is not connected to either of the refrigerant gas suction chambers.

When the compressor and the oil pump are started, the reduced pressure within the rear refrigerant gas suction chamber 19 is introduced into the additional oil suction chamber 222 through the introducing passage 300, as in the first embodiment. Thus, the lubricating oil is directed into the additional oil suction chamber 222 from the oil sump 8 by the pressure difference between the oil sump 8 and the additional oil suction chamber 222. The lubricating oil, which reaches the additional oil suction chamber 222, fills the clearances between the pump element, in particular, the clearance C between the pump 21 and the chamber 20 (refer to FIG. 2), as in the first embodiment, which increases the suction efficient of the pump 21 during the initial stage of the starting of the compressor. Thus, suction efficient of the pump 21 is increased quickly so that the lubricating oil is directed to the main and additional oil suction chambers 221 and 222 from the oil sump 8. After the compressor is started, the level of the lubricating oil in the oil sump 8 is lowered so that the opening of the second oil suction passage 224 appears above the surface of the oil. Thus, when the compressor and the oil pump are in the normal operation, the oil is not directed to the additional oil suction chamber 222 through the second oil suction passage 224, which minimizes the oil directed to the rear refrigerant gas suction chamber 19 through the introducing passage 300, namely, the entainment of the oil into the refrigerant gas.

We claim:

1. A reciprocating piston type compressor for compressing refrigerant gas including:

a cylinder block with a plurality of axially extending cylinder bores arranged around the longitudinal axis of the cylinder block; a plurality of pistons slidably provided within the cylinder bores for reciprocation between the top and bottom dead centers;

housing means sealingly mounted to ends of the cylinder block with valve plates therebetween, the housing means including at least a refrigerant gas suction chamber which is fluidly connected to the cylinder bores and an external refrigerating circuit, to introduce the refrigerant gas from the external refrigerating circuit into the cylinder bores when the pistons move toward the bottom dead center;

an axially extending drive shaft for driving the motion of the reciprocating pistons;

an oil sump for containing lubricating oil;

an oil pump, which is driven by the drive shaft, for distributing the lubricating oil to the compressor elements, the oil pump including an oil suction chamber which is fluidly connected to the oil sump through an oil suction passage; and means for introducing pressure in the refrigerant gas suction chamber into the oil suction chamber to direct the lubricating oil in the oil sump into the oil suction chamber during the initial stage of the starting of the compressor.

2. A reciprocating piston type compressor according to claim 1, in which the housing means further includes a pump chamber; and the oil pump being a trochoidal pump which includes an outer wall for defining a cylindrical pump chamber, the oil suction chamber and an oil discharge chamber, an external gear driven by the drive shaft and an internal gear meshing with the external gear to rotate along the inner surface of the pump chamber.

3. A reciprocating piston type compressor according to claim 2, in which the introducing passage is provided in the outer wall of the trochoidal pump.

4. A reciprocating piston type compressor according to claim 2, in which the introducing passage is provided in the valve plate.

5. A reciprocating piston type compressor according to claim 1, in which the oil suction chamber includes first and second oil suction chambers;

the oil suction passage including first and second passages, the first oil suction passage opening into the first oil suction chamber of a first end and the oil sump at a level near the bottom of the oil sump at a second end, and the second oil suction passage opening into the second oil chamber at a first end and the oil sump, at a level directly beneath the top surface of the oil contained in the oil sump when the compressor is not in operation, at a second end and the introducing means being a passage which is provided between the refrigerant gas suction chamber and the second oil suction chamber.

6. A reciprocating piston type compressor according to claim 5, in which the housing means further includes a pump chamber; and the oil pump being a trochoidal pump which includes an outer wall for defining a cylindrical pump chamber, the oil suction chamber and an oil discharge chamber, an external gear driven by the drive shaft and an internal gear meshing with the external gear to rotate along the inner surface of the pump chamber.

7. A reciprocating piston type compressor according to claim 6, in which the introducing passage is provided in the outer wall of the trochoidal pump.

8. A reciprocating piston type compressor according to claim 6, in which the introducing passage is provided in the valve plate.

* * * * *